US005584985A

United States Patent [19]

Lomas

[11] Patent Number: 5,584,985

[45] Date of Patent: Dec. 17, 1996

[54] FCC SEPARATION METHOD AND APPARATUS WITH IMPROVED STRIPPING

[75] Inventor: David A. Lomas, Barrington, Ill.

[73] Assignee: UOP, Des Plaines, Ill.

[21] Appl. No.: 364,621

[22] Filed: Dec. 27, 1994

[51] Int. Cl.[6] ..... C10G 11/00

[52] U.S. Cl. ..... 208/113; 208/150; 208/151; 208/161

[58] Field of Search ..... 208/161, 113, 208/150, 151

[56] References Cited

U.S. PATENT DOCUMENTS

| | | | |
|---|---|---|---|
| 2,535,140 | 12/1950 | Kassel | 183/83 |
| 4,397,738 | 8/1983 | Kemp | 208/161 |
| 4,482,451 | 11/1984 | Kemp | 208/161 |
| 4,581,205 | 4/1986 | Schatz | 208/113 |
| 4,670,410 | 6/1987 | Baillie | 502/41 |
| 4,689,206 | 8/1987 | Owen et al. | 422/144 |
| 4,701,307 | 10/1987 | Walters et al. | 422/147 |
| 4,738,829 | 4/1988 | Krug | 208/151 |
| 4,792,437 | 12/1988 | Hettinger, Jr. et al. | 422/147 |
| 4,963,328 | 10/1990 | Haddad et al. | 208/113 |
| 4,988,430 | 1/1991 | Sechrist et al. | 208/113 |
| 5,262,046 | 11/1993 | Forgac et al. | 208/161 |

*Primary Examiner*—Anthony McFarlane
*Assistant Examiner*—Walter D. Griffin
*Attorney, Agent, or Firm*—Thomas K. McBride; John G. Tolomei

[57] ABSTRACT

In this invention a cyclonic separation method and apparatus discharges particulate solids and gaseous fluids into a separation vessel from a discharge opening of a central conduit and withdraws separated gaseous fluids from the separation vessel that contacts the catalyst in the separation vessel with redistributed gases from outside the separation vessel. The invention increases the effective utilization of available stripping medium in an FCC process.

4 Claims, 1 Drawing Sheet

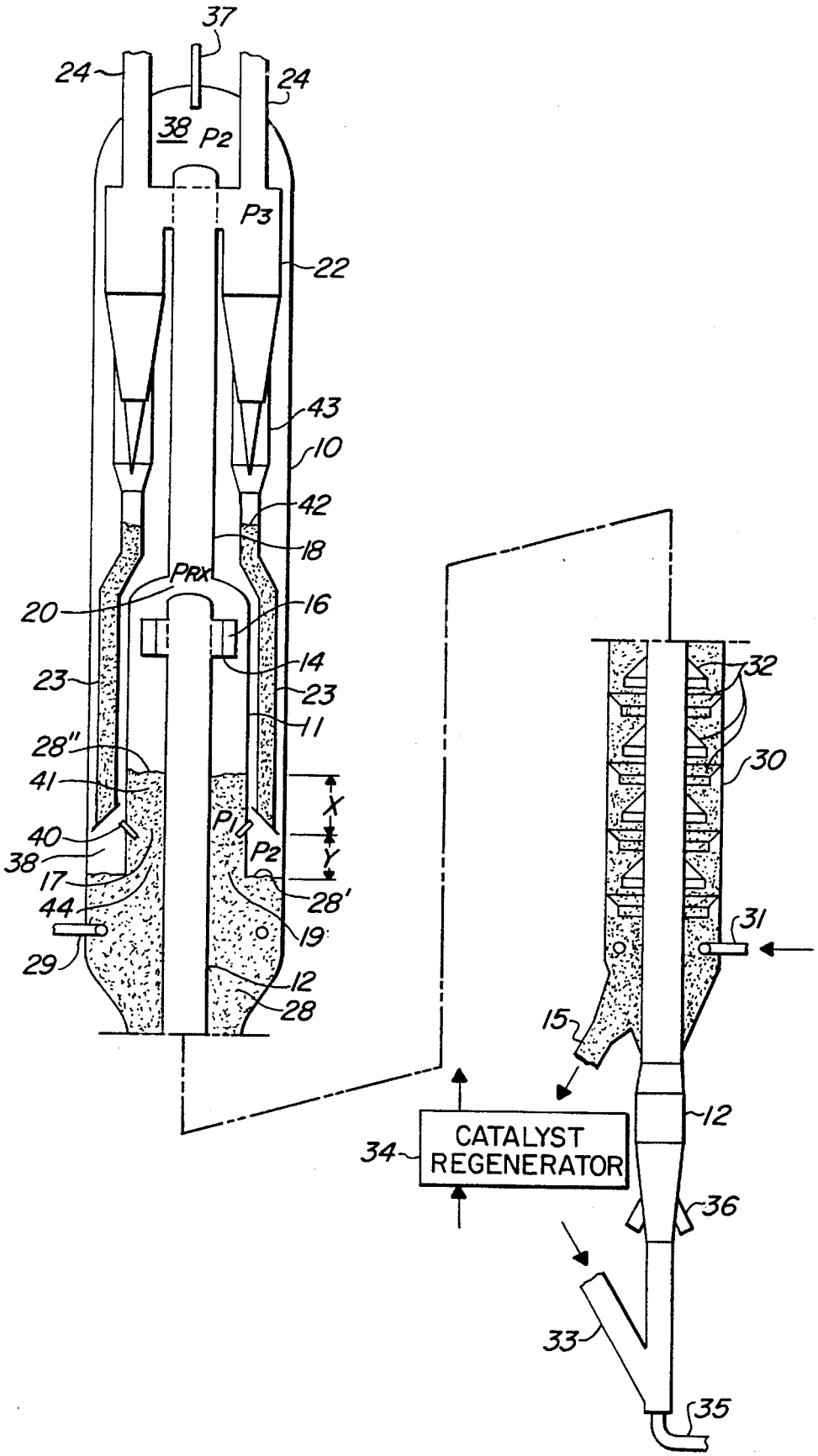
37
24
24
38
P2
P3
22
43
10
42
18
PRX
20
16
14
23
23
11
28"
41
X
P1
P2
Y
40
38
17
28'
44
19
29
12
28
32
30
31
15
12
CATALYST
REGENERATOR
34
36
33
35

FCC SEPARATION METHOD AND APPARATUS WITH IMPROVED STRIPPING

BACKGROUND OF THE INVENTION

1. Field of the Invention

This invention relates generally to processes for the separation of solid catalyst particles from gases and the stripping of hydrocarbons from catalyst. More specifically, this invention relates to the separation of catalyst and gaseous materials from a mixture thereof in a cyclonic disengaging vessel of an FCC process.

2. Description of the Prior Art

Cyclonic methods for the separation of solids from gases are well known and commonly used. A particularly well known application of such methods is in the hydrocarbon processing industry were particulate catalysts contact gaseous reactants to effect chemical conversion of the gas stream components or physical changes in the particles undergoing contact with the gas stream.

The FCC process presents a familiar example of a process that uses gas streams to contact a finally divided stream of catalyst particles and effects contact between the gas and the particles. The FCC processes, as well as separation devices used therein are fully described in U.S. Pat. Nos. 4,701,307 and 4,792,437, the contents of which are hereby incorporated by reference.

The most common method of separating particulate solids from a gas stream uses a cyclonic separation. Cyclonic separators are well known and operate by imparting a tangential velocity to a gases containing entrained solid particles that forces the heavier solids particles outwardly away from the lighter gases for upward withdrawal of gases and downward collection of solids. Cyclonic separators usually comprise relatively small diameter cyclones having a tangential inlet on the outside of a cylindrical vessel that forms the outer housing of the cyclone.

Cyclones for separating particulate material from gaseous materials are well known to those skilled in the art of FCC processing. In the operation of an FCC cyclone tangential entry of the gaseous materials and catalyst creates a spiral flow path that establishes a vortex configuration in the cyclone so that the centripetal acceleration associated with an outer vortex causes catalyst particles to migrate towards the outside of the barrel while the gaseous materials enter an inner vortex for eventual discharge through an upper outlet. The heavier catalyst particles accumulate on the side wall of the cyclone barrel and eventually drop to the bottom of the cyclone and out via an outlet and a dip leg conduit for recycle through the FCC arrangement. Cyclone arrangements and modifications thereto are generally disclosed in U.S. Pat. Nos. 4,670,410 and 2,535,140.

The FCC process is representative of many processes for which methods are sought to quickly separate gaseous fluids and solids as they are discharged from a conduit. In the FCC process one method of obtaining this initial quick discharge is to directly connect a conduit containing a reactant fluid and catalyst directly to a traditional cyclone separators. While improving separation, there are drawbacks to directly connecting a conduit discharging a mixture of solids and gaseous fluids into cyclone separators. Where the mixture discharged into the cyclones contains a high loading of solids, direct discharge requires large cyclones. In addition, instability in the delivery of the mixture may also cause the cyclones to function poorly and to disrupt the process where pressure pulses cause an unacceptable carryover of solids with the vapor separated by the cyclones. Such problems are frequently encountered in processes such as fluidized catalytic cracking. Accordingly, less confined systems are often sought to effect an initial separation between a mixture of solid particles and gaseous fluids.

U.S. Pat. Nos. 4,397,738 and 4,482,451, the contents of which are hereby incorporated by reference, disclose an alternate arrangement for cyclonic separation that tangentially discharges a mixture of gases and solid particles from a central conduit into a containment vessel. The containment vessel has a relatively large diameter and generally provides a first separation of solids from gases. This type of arrangement differs from ordinary cyclone arrangements by the discharge of solids from the central conduit and the use of a relatively large diameter vessel as the containment vessel. In these arrangements the initial stage of separation is typically followed by a second more compete separation of solids from gases in a traditional cyclone vessel.

In addition to the separation of the solid catalyst from the gases, effective operation of the FCC process also requires the stripping of hydrocarbons from the solid catalyst as it passes from the reactor to a regenerator. Stripping is usually accomplished with steam that displaces adsorbed hydrocarbons from the surface and within the pores of the solid catalytic material. It is important to strip as much hydrocarbon as possible from the surface of the catalyst to recover the maximum amount of product and minimize the combustion of hydrocarbons in the regenerator that can otherwise produce excessive temperatures in the regeneration zone.

U.S. Pat. No. 4,689,206 discloses a separation and stripping arrangement for an FCC process that tangentially discharges a mixture of catalyst and gases into a separation vessel and passes gases upwardly from a lower stripping zone into a series of baffles for displacing hydrocarbons from the catalyst within the separation vessel. While the arrangement shown in U.S. Pat. No. 4,689,206 may effect some stripping of hydrocarbon gases from the catalyst in the separation vessel, the arrangement does not utilize all of the available gases for stripping of the hydrocarbons in the separation vessel and does not distribute the stripping gas that enters the separation vessel in a manner that insures its effective use via good dispersion within the catalyst phase.

While it is beneficial to effect as much stripping and recover as many hydrocarbons as possible from FCC catalyst, refiners have come under increasing pressure to reduce the amount of traditional stripping medium that are used to effect stripping. The pressure stems from the difficulty of disposing the sour water streams that are generated by the contacting the catalyst with steam in typical stripping operations. Therefore, while more efficient process operations call for the use of more effective hydrocarbon stripping from FCC catalyst, the quantities of the preferred stripping mediums are being restricted.

BRIEF SUMMARY OF THE INVENTION

It has now been discovered that the stripping efficiency of a cyclonic separation that centrally discharges particles into a separation chamber may be surprisingly improved by operating a reactor vessel in a specific manner that channels all of the available stripping gases into the separation vessel while simultaneously distributing the gases in a manner that increases the effectiveness of stripping in the separation chamber. In accordance with this discovery the gaseous fluids in the reactor vessel that surround the separation chamber are maintained at a higher pressure within the reactor vessel than the pressure within the separation chamber. The higher pressure creates a net gas flow from the volume of the reactor vessel that surrounds the separation chamber into the separation vessel. The effectiveness of the stripping is enhanced by directing some or all of this gas into a catalyst bed within the separation chamber at a location above the bottom of the separation chamber across a plurality of flow restrictions. The flow restrictions insure that gases entering the separation chamber will have a uniform distribution that puts the gas to effective use as a stripping medium.

Accordingly, in one embodiment this invention is a process for the fluidized catalytic cracking of a hydrocarbon feedstock. The process passes hydrocarbon feedstock and solid catalyst particles into a riser conversion zone comprising a conduit to produce a mixture of solid particles and gaseous fluids. The mixture passes into a separation vessel through the conduit wherein the conduit occupies a central portion of the separation vessel and the separation vessel is located within a reactor vessel. The conduit tangentially discharging the mixture from a discharge opening into the separation vessel. Catalyst particles pass into a first catalyst bed located in a lower portion of the separation vessel and contact the catalyst particles with a first stripping gas in the first bed. Catalyst particles pass from the first bed into a second bed located in the separation vessel below the first catalyst bed. Catalyst particles contact a second stripping gas and the second stripping gas passes into the first catalyst bed to supply a portion of the first stripping gas. The catalyst particles from the second bed pass to a stripping zone and contact a third stripping gas in the stripping zone. The third stripping gas passes into the second catalyst bed to supply at least a portion of the second stripping gas. A purge medium passes into an upper portion of the reactor vessel and at least a portion of the purge gas passes through a plurality of restricted opening arranged circumferentially around the outside of the separation vessel at the bottom of the first catalyst bed to supply a portion of the first stripping gas. Stripped catalyst particles are recovered from the first stripping zone. An outlet withdraws collected gaseous fluids including the first stripping gas and catalyst particles from an upper portion of the separation vessel into an outlet and withdraws gaseous fluids from the separation vessel.

In another embodiment this invention is an apparatus for separating solid particles from a stream comprising a mixture of gaseous fluids and solid particles. The apparatus comprises a reactor vessel; a separation vessel located in the reaction vessel; and a mixture conduit extending into the separation vessel and defining a discharge opening located within the vessel. The discharge opening is tangentially oriented for discharging the stream into the vessel and imparting a tangential velocity to the stream. A particle outlet defined by the separation vessel discharges particles from a lower portion of the vessel. A stripping vessel is located below the separation vessel. A gas recovery conduit defines an outlet for withdrawing gaseous fluids from within the separation vessel and a cyclone separator is in communication with the gas recovery conduit. A plurality of nozzles are located above the bottom of the separation vessel and extend circumferentially around the separation vessel for communicating the separation vessel with the reactor vessel.

By maintaining the a bed of catalyst in the separation vessel and injecting stripping fluid from the reactor vessel into the dense bed of the separation vessel at a location above the bottom of the separation vessel all available gases in the reactor vessel are used as stripping medium. Such gases include the purge gas that enters the top of the reactor vessel to displace hydrocarbons that collect at the top of the vessel as well as cracked hydrocarbon gases from the dip legs of the cyclones. The cracked gases from the dip legs of the cyclones are particularly effective as stripping gases since they have undergone cracking to the point of being essentially inert as a result of the long residence time in the cyclone dip legs. Using all of the gases that are already present in the reactor vessel as a stripping medium that passes through the separation vessel can reduce the total requirements for stripping steam that would otherwise be needed to achieve a desired degree of stripping. Eliminating steam requirements is particularly beneficial to refiners that are increasingly faced with treating costs associated with the disposal of the sour water generated thereby.

In addition, the method and apparatus of this invention can further reduce steam requirement by utilizing the available stripping gas in a more effective manner that has been utilized in the past. Prior an arrangements for stripping catalyst in a separation vessel admit the stripping gas through the typically large bottom opening of the separation vessel. The gas does not generally enter such an opening uniformly and tends to flow in primarily to one side or the other. Injecting the stripping gas from the reactor vessel into the dense bed of the separation vessel across a plurality of nozzles distributes the stripping gas in a manner that uniformly injects the stripping gas over the circumference of the vessel. With tiffs manner of distribution the gas is used effectively as a stripping medium.

Additional details and embodiments of the invention will become apparent from the following detailed description of the invention.

BRIEF DESCRIPTION OF THE DRAWING

The FIGURE is a sectional elevation of an FCC reactor vessel schematically showing a separation vessel arranged in accordance with this invention.

DETAILED DESCRIPTION OF THE INVENTION

The apparatus of this invention comprises a separation vessel into which a mixture conduit that contains the mixture of solid particles transported by a gaseous fluid discharges the particles and gaseous fluid mixture. The separation vessel is preferably a cylindrical vessel. The cylindrical vessel promotes the swirling action of the gaseous fluids and solids as they are discharged tangentially from a discharge opening of the mixture conduit into the separation vessel. The separation vessel will preferably have an open interior below the discharge opening that will still provide satisfactory operation in the presence of some obstructions such as conduits or other equipment which may pass through the separation vessel.

The discharge opening and the conduit portion upstream of the discharge opening are constructed to provide a tangential velocity to the exiting mixture of gaseous fluids and solids. The discharge opening may be defined using vanes or baffles that will impart the necessary tangential velocity to the exiting gaseous fluids and solids. Preferably the discharge outlet is constructed with conduits or arms that extend outwardly from a central mixture conduit. Providing a section of curved arm upstream of the discharge conduit will provide the necessary momentum to the gaseous fluids and solids as they exit the discharge opening to continue in a tangential direction through the separation vessel. The separation vessel has an arrangement that withdraws catalyst particles from the bottom of the vessel so that the heavier solid particles disengage downwardly from the lighter gaseous fluids. A bed of solid particles is maintained at the bottom of the separation vessel that extends into the separation vessel. The separated gases from the separation vessel will contain additional amounts of entrained catalyst that are typically separated in cyclone separators. Preferred cyclone separators will be of the type that having inlets that are directly connected to the outlet of the separation vessel. Additional details of this type of separation arrangement may be obtained from previously referenced U.S. Pat. No. 4,482,451.

An essential feature of this invention is the location of a plurality of restricted openings arranged circumferentially around the outside of the separation vessel. The outlets are located above the bottom outlet of the separation vessel and below the top of the dense catalyst phase maintained within the separation vessel. To insure good distribution the restricted openings create a pressure drop of at least 0.25 psi. The restricted openings are preferably in the form of nozzles that provide orifices to direct the gas flow into the dense catalyst phase of the separation vessel. The nozzles will preferably have orifice opening diameters of 1 inch or less and a spacing around the circumference of the separation vessel of less 12 inches and more preferably less than 6 inches. To obtain a uniform pressure drop all of the restricted openings are preferably located at the same elevation in the wall of the separation vessel.

The gas flows into the reactor vessel that can enter the restricted openings of the separation vessel as stripping medium come from a variety of sources. The primary source is the purge medium that enters the reactor vessel. In the absence of the purge, the volume of the reactor vessel that surrounds the separation chamber and a direct connected cyclones arrangement would remain relatively inactive during the reactor operation. The purge medium provides the necessary function of sweeping the otherwise relatively inactive volume free of hydrocarbons that would otherwise lead to coke formation in the vessel. Since this purge medium is usually steam it readily supplies a potential stripping gas. Another stripping medium is available from the catalyst outlets of the cyclones. The recovered catalyst exiting the cyclones contains additional mounts of entrained gases that enter the reactor vessel. As mentioned previously, these gases are rendered relatively inert by a long residence time in the cyclone dip legs that cracks the heavy components to extinction.

The effective utilization of the stripping gas streams from the reactor vessel in the manner of this invention employs a particular pressure balance between the separation vessel, the surrounding reactor environment, and the restricted openings. The pressure balance of this invention maintains a higher pressure in the reactor vessel than the separation vessel. Maintaining the necessary pressure balance demands that a dense catalyst phase extend upward in the reactor above the bottom and into the separation vessel. For the purposes of this invention a dense catalyst phase is defined as a catalyst density of at least 20 lb/ft$^3$. The dense catalyst phase extends upward within the lower portion of the separation vessel to a height above the restricted openings. As hereinafter explained in the specific embodiment, the height of the dense catalyst phase above the restricted openings is limited by the maximum differential pressure across the cyclones from the cyclone inlet to the dip leg outlet. The maximum differential across the cyclones can be increased by increasing the length of the cyclone dip leg.

The restricted openings or nozzles are located above the bottom of the separation vessel to maintain a head of dense catalyst between the restricted openings and the bottom of the separation vessel. This head of catalyst forces at least a portion of the gases from the reactor to flow into the separation vessel through the restricted openings instead of the bottom separation vessel opening since, in accordance with this invention, the pressure in the reactor vessel always exceeds the pressure in the separation vessel at the restricted openings. Preferably the head of catalyst in the separation vessel below the restricted openings will remain greater than the pressure drop across the restricted openings so that all of the gas from the reactor vessel will flow through the restricted openings and undergo redistribution before stripping catalyst in the separation vessel.

The pressure balance requirements and operation of the process are more fully described in the following description of the preferred embodiment.

DESCRIPTION OF THE PREFERRED EMBODIMENT

Looking then at the FIGURE, the schematic illustration depicts a separation arrangement in a reactor vessel 10. A central conduit in the form of a reactor riser 12 extends upwardly from a lower portion of the reactor vessel 10 in a typical FCC arrangement. The central conduit or riser preferably has a vertical orientation within the reactor vessel 10 and may extend upwardly from the bottom of the reactor vessel or downwardly from the top of the reactor vessel. Riser 12 terminates in an upper portion of a separation vessel 11 with an curved conduit in the form of an arm 14. Arm 14 discharges a mixture of gases fluids and solid particles comprising catalyst.

Tangential discharge of gases and catalyst from a discharge opening 16 produces a swirling helical pattern about the interior of separation vessel 11 below the discharge opening 16. Centripetal acceleration associated with the helical motion forces the heavier catalyst particles to the outer portions of separation vessel 11. Catalyst from discharge openings 16 collects in the bottom of separation vessel 11 to form a dense catalyst bed 17.

The gases, having a lower density than the solids, more easily change direction and begin an upward spiral with the gases ultimately traveling into a gas recovery conduit 18 having an inlet 20. In a preferred form of the invention (not depicted by the FIGURE) inlet 20 is located below the discharge opening 16. The gases that enter gas recovery conduit 18 through inlet 20 will usually contain a light loading of catalyst particles. Inlet 20 recovers gases from the discharge conduit as well as stripping gases which are hereinafter described. The loading of catalyst particles in the gases entering conduit 18 are usually less than 1 lb/ft.$^3$ and typically less than. 0.1 lb/ft$^3$.

Gas recovery conduit 18 passes the separated gases into a cyclones 22 that effect a further removal of particulate material from the gases in the gas recovery conduit. Cyclones 22 operate as conventional direct connected cyclones in a conventional manner with the tangential entry of the gases creating a swirling action inside the cyclones to establish the well known inner and outer vortexes that separate catalyst from gases. A product stream, relatively free of catalyst particles, exits the reactor vessel 10 through outlets 24.

Catalyst recovered by cyclones 22 exits the bottom of the cyclone through dip-leg conduits 23 and passes through a lower portion of the reactor vessel 10 where it collects with catalyst that exits separation vessel 17 through an open bottom 19 to form a dense catalyst bed 28 having an top surface 28' in the portion outside the separator vessel 11 and a top surface 28" within separation vessel 11. Catalyst from catalyst bed 28 passes downwardly through a stripping vessel 30. A stripping fluid, typically steam enters a lower portion of stripping vessel 30 through a distributor 31. Countercurrent contact of the catalyst with the stripping fluid through a series of stripping baffles 32 displaces product gases from the catalyst as it continues downwardly through the stripping vessel. Fluidizing gas or additional stripping medium may be added at the top of catalyst bed 28 by distributor 29.

Stripped catalyst from stripping vessel 30 passes through a conduit 15 to a catalyst regenerator 34 that rejuvenates the catalyst by contact with an oxygen-containing gas. High temperature contact of the oxygen-containing gas with the catalyst oxidizes coke deposits from the surface of the catalyst. Following regeneration catalyst particles enter the bottom of reactor riser 12 through a conduit 33 where a fluidizing gas from a conduit 35 pneumatically conveys the catalyst particles upwardly through the riser. As the mixture of catalyst and conveying gas continues up the riser, nozzles 36 inject feed into the catalyst, the contact of which vaporizes the feed to provide additional gases that exit through discharge opening 16 in the manner previously described.

The volume of the reactor outside cyclones 22 and separation vessel 11, referred to as outer volume 38, is kept under a positive pressure, $P_2$, relative to the pressure, $P_3$, inside the cyclones and the pressure $P_1$, in the separation vessel by the addition of a purge medium that enters the top of the vessel through a nozzle 37. The purge medium typically comprises steam and is used to maintain a low hydrocarbon partial pressure in outer volume 38 to prevent the problem of coking as previously described.

This invention adds the restricted openings in the form of nozzles 40 so that all of the purge entering nozzle 37 is used effectively used as a stripping or prestripping medium in an upper portion 41 of dense catalyst bed 17. The minimum positive pressure $P_2$ is equal to the pressure, $P_{Rx}$, of the reactants at the outlets 16, the pressure drop associated with the head of catalyst above the nozzles 40 and any additional pressure drop across nozzles 40. If the pressure drop across the nozzles 40 is ignored the minimum positive pressure is equal to $P_1$. The height of dense catalyst bed portion 41, indicated as X in the FIGURE, is essential to the operation of this invention since it provides the location for full utilization of the available stripping medium by the initial stripping of the majority of the catalyst as it enters the separation vessel. Height X will usually extend upward for at least a foot. As discussed earlier the height X is limited by the available length of dip leg 23. As height X increases, the additional catalyst head raises the value of pressure $P_1$ and the minimum pressure for $P_2$. Since pressure $P_3$ equals the pressure $P_{RX}$ minus the cyclone pressure drop, pressure in the upper part of the cyclone remains constant relative to $P_{RX}$. Therefore, raising pressure $P_2$ at the bottom of dip leg 23 increases the level of dense catalyst within dip leg 23. As a result the height X must be kept below a level that would cause dense catalyst level 42 to enter the barrel portion 43 of cyclones 22. Thus in a preferred form of the invention, the pressure $P_2$ is regulated on the basis of the catalyst level in separation vessel 11.

The maximum value of pressure $P_2$ is also limited relative to pressure $P_1$ by the distance that the lower portion 44 of bed 17 extends below nozzles 40. Once the pressure $P_2$ exceeds pressure $P_1$ by an amount equal to the head of catalyst over height Y, gas from outer volume 38 will flow under the bottom of the separation vessel and into its interior through opening 19. Thus, the height Y serves as a limitation on the pressure drop through nozzles 40 which can never exceed the pressure developed by the head of catalyst over height Y. Therefore, there is no limitation on the amount of purge medium that can enter the process through nozzle 37 and any additional amounts of stripping or purge gas that enter the regenerator vessel flow in to the separation vessel through bottom opening 19. In order to capture as much available stripping medium as possible for redistribution and stripping in separation vessel 11, height Y will provide a minimum distance corresponding to the desired pressure drop across nozzles 40 to eliminate the flow of gas into bottom opening 19. As the pressure drop across nozzles 40 decreases to the point of preventing gas flow from the outer volume 38 through the bottom opening 19, the top of bed 28 will lie somewhere between bed level 28' and the elevation of nozzles 40. Further decreases in flow of purge gas will bring the top level of bed 28 close to nozzles 40. Preferably the height Y of catalyst is maintained such that all of the gaseous materials in outer volume 38 passes through nozzles 40 without gas flowing into separation vessel 11 through opening 19. In most arrangements the distance Y will equal at least 12 inches. Thus, in the preferred arrangement all of the stripping gas from bed 28 will flow into bed portion 44 and all of the stripping gas from bed portion 44 along with the gas from outer volume 38 will flow through bed portion 41 as a stripping medium.

What is claimed is:

1. An FCC process for the fluidized catalytic cracking of a hydrocarbon feedstock comprising:

passing a hydrocarbon feedstock and solid catalyst particles into a riser conversion zone comprising a conduit to produce a mixture of solid particles and gaseous fluids;

passing said mixture of said catalyst particles and gaseous fluids into a separation vessel through said conduit wherein said conduit occupies a central portion of said separation vessel and said separation vessel is located within a reactor vessel;

tangentially discharging said mixture from said conduit through a discharge opening into said separation vessel;

passing catalyst particles into a first catalyst bed located in a lower portion of said separation vessel and contacting said catalyst particles with a first stripping gas in said first bed;

passing said catalyst particles from said first bed into a second bed located in said separation vessel below said first catalyst bed, contacting said catalyst particles with a second stripping gas and passing said second stripping gas into said first catalyst bed to supply a portion of said first stripping gas;

passing said catalyst particles from said second bed to a stripping zone, contacting said particles with a third stripping gas in said stripping zone and passing said third stripping gas into said second catalyst bed to supply at least a portion of said second stripping gas;

passing a purge medium into an upper portion of said reactor vessel;

passing at least a portion of said purge medium through a plurality of restricted openings arranged circumferentially around the outside said separation vessel at the bottom of said first catalyst bed to supply a portion of said first stripping gas;

recovering stripped catalyst particles from said stripping zone; and, collecting gaseous fluids including said first stripping gas and catalyst particles from an upper portion of said separation vessel into an outlet and withdrawing gaseous fluids from said separation vessel for recovery.

2. The process of claim 1 wherein a portion of said purge medium passes into the bottom of said second catalyst bed.

3. The process of claim 1 wherein said restricted openings create a pressure drop of at least 0.25 psi.

4. The process of claim 1 wherein said gaseous fluids are separated in a cyclone separator, catalyst particles from said cyclone are passed to said stripping zone and hydrocarbons entrained with the catalyst from said cyclone separator pass through said restricted openings.

* * * * *